US009989905B2

(12) United States Patent
Seki et al.

(10) Patent No.: US 9,989,905 B2
(45) Date of Patent: Jun. 5, 2018

(54) FIXING DEVICE AND IMAGE FORMING APPARATUS

(71) Applicants: Takayuki Seki, Kanagawa (JP); Takashi Seto, Kanagawa (JP); Hiroshi Yoshinaga, Chiba (JP); Kenji Ishii, Kanagawa (JP); Ippei Fujimoto, Kanagawa (JP); Kazunari Sawada, Kanagawa (JP)

(72) Inventors: Takayuki Seki, Kanagawa (JP); Takashi Seto, Kanagawa (JP); Hiroshi Yoshinaga, Chiba (JP); Kenji Ishii, Kanagawa (JP); Ippei Fujimoto, Kanagawa (JP); Kazunari Sawada, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days. days.

(21) Appl. No.: 15/604,294

(22) Filed: May 24, 2017

(65) Prior Publication Data

US 2017/0364000 A1 Dec. 21, 2017

(30) Foreign Application Priority Data

Jun. 15, 2016 (JP) ..... 2016-118654

(51) Int. Cl.
*G03G 15/20* (2006.01)

(52) U.S. Cl.
CPC ..... *G03G 15/2053* (2013.01)

(58) Field of Classification Search
CPC ..... G03G 15/2053; G03G 2215/2035; G03G 15/2064; G03G 15/2017; G03G 15/2042
(Continued)

(56) References Cited

U.S. PATENT DOCUMENTS

2003/0042241 A1* 3/2003 Uekawa ..... G03G 15/2053 219/216
2007/0125526 A1* 6/2007 Satou ..... H01L 23/473 165/121

(Continued)

FOREIGN PATENT DOCUMENTS

JP 2007-310220 11/2007
JP 2010-078839 4/2010

(Continued)

OTHER PUBLICATIONS

U.S. Appl. No. 15/375,757, filed Dec. 12, 2016.
U.S. Appl. No. 15/440,179, filed Feb. 23, 2017.

*Primary Examiner* — Walter L Lindsay, Jr.
*Assistant Examiner* — Frederick Wenderoth
(74) *Attorney, Agent, or Firm* — Duft Bornsen & Fettig LLP

(57) ABSTRACT

A fixing device includes a nip formation pad which is disposed opposite an endless belt and forms a fixing nip between the endless belt and a pressure rotator. A contact heater is disposed at least at one lateral end of the nip formation pad in a longitudinal direction thereof and heats at least one lateral end of the endless belt in an axial direction thereof. A thermal conduction aid contacts a belt-side face of each of the nip formation pad and the contact heater and conducts heat in the axial direction of the endless belt. A cover is disposed outboard from the thermal conduction aid in a longitudinal direction thereof. The cover covers the belt-side face of the contact heater. The contact heater includes a power supply portion disposed outboard from the thermal conduction aid in the longitudinal direction thereof and covered by the cover.

12 Claims, 8 Drawing Sheets

(58) Field of Classification Search
USPC ..... 399/329
See application file for complete search history.

(56) References Cited

U.S. PATENT DOCUMENTS

| | | | | |
|---|---|---|---|---|
| 2010/0072892 | A1* | 3/2010 | Watanabe | H01J 5/38 313/579 |
| 2013/0308990 | A1* | 11/2013 | Samei | G03G 15/2053 399/329 |
| 2016/0161890 | A1 | 6/2016 | Shoji et al. | |
| 2016/0223961 | A1 | 8/2016 | Takagi et al. | |
| 2016/0274511 | A1 | 9/2016 | Ogino et al. | |
| 2016/0274514 | A1 | 9/2016 | Ishii et al. | |
| 2016/0334742 | A1 | 11/2016 | Kobashigawa et al. | |
| 2016/0378027 | A1 | 12/2016 | Sawada et al. | |

FOREIGN PATENT DOCUMENTS

| | | |
|---|---|---|
| JP | 2011-033939 | 2/2011 |
| JP | 2014-056146 | 3/2014 |
| JP | 2014-126773 | 7/2014 |
| JP | 2014-178370 | 9/2014 |

* cited by examiner

FIXING DEVICE AND IMAGE FORMING APPARATUS

CROSS-REFERENCE TO RELATED APPLICATION

This patent application is based on and claims priority pursuant to 35 U.S.C. § 119 to Japanese Patent Application No. 2016-118654, filed on Jun. 15, 2016, in the Japanese Patent Office, the entire disclosure of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt (e.g., an endless belt), and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes an endless belt that is flexible. A pressure rotator is disposed opposite an outer circumferential surface of the endless belt. A nip formation pad is disposed opposite an inner circumferential surface of the endless belt and forms a fixing nip between the endless belt and the pressure rotator. The nip formation pad includes a belt-side face disposed opposite the endless belt. At least one radiant heater is disposed opposite the inner circumferential surface of the endless belt to heat the endless belt. A contact heater is disposed at least at one lateral end of the nip formation pad in a longitudinal direction of the nip formation pad and heats at least one lateral end of the endless belt in an axial direction of the endless belt. The contact heater includes a belt-side face disposed opposite the endless belt. A thermal conduction aid contacts the belt-side face of the nip formation pad and the belt-side face of the contact heater and conducts heat in the axial direction of the endless belt. A cover is disposed outboard from the thermal conduction aid in a longitudinal direction of the thermal conduction aid. The cover covers the belt-side face of the contact heater. The contact heater further includes a power supply portion disposed outboard from the thermal conduction aid in the longitudinal direction of the thermal conduction aid and covered by the cover.

This specification further describes an improved image forming apparatus. In one exemplary embodiment, the image forming apparatus includes an image forming device to form a toner image and a fixing device disposed downstream from the image forming device in a recording medium conveyance direction to fix the toner image on a recording medium. The fixing device includes an endless belt that is flexible. A pressure rotator is disposed opposite an outer circumferential surface of the endless belt. A nip formation pad is disposed opposite an inner circumferential surface of the endless belt and forms a fixing nip between the endless belt and the pressure rotator. The nip formation pad includes a belt-side face disposed opposite the endless belt. At least one radiant heater is disposed opposite the inner circumferential surface of the endless belt to heat the endless belt. A contact heater is disposed at least at one lateral end of the nip formation pad in a longitudinal direction of the nip formation pad and heats at least one lateral end of the endless belt in an axial direction of the endless belt. The contact heater includes a belt-side face disposed opposite the endless belt. A thermal conduction aid contacts the belt-side face of the nip formation pad and the belt-side face of the contact heater and conducts heat in the axial direction of the endless belt. A cover is disposed outboard from the thermal conduction aid in a longitudinal direction of the thermal conduction aid. The cover covers the belt-side face of the contact heater. The contact heater further includes a power supply portion disposed outboard from the thermal conduction aid in the longitudinal direction of the thermal conduction aid and covered by the cover.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
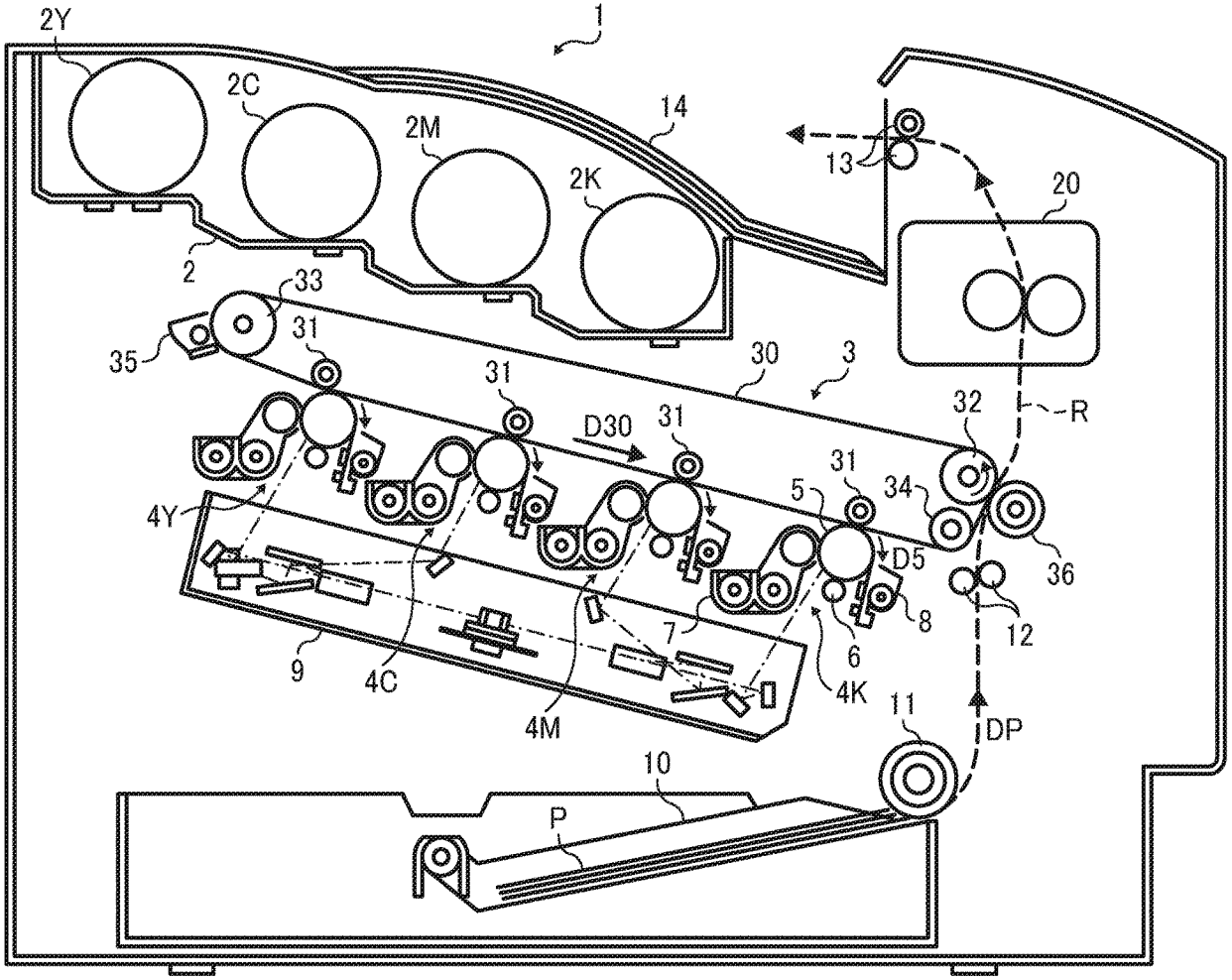
FIG. 1 is a schematic vertical cross-sectional view of an image forming apparatus according to an exemplary embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1, an image forming apparatus 1 according to an exemplary embodiment is explained.

FIG. 1 is a schematic vertical cross-sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color printer that forms a color toner image on a recording medium by electrophotography. Alternatively, the image forming apparatus 1 may be a monochrome printer that forms a monochrome toner image on a recording medium.

Referring to FIG. 1, a description is provided of a construction of the image forming apparatus 1.

As illustrated in FIG. 1, the image forming apparatus 1 is a color laser printer including four image forming devices 4Y, 4C, 4M, and 4K situated in a center portion of the image forming apparatus 1. The image forming devices 4Y, 4C, 4M, and 4K are aligned in a stretch direction in which an intermediate transfer belt 30 is stretched. Although the image forming devices 4Y, 4C, 4M, and 4K contain developers in different colors, that is, yellow, cyan, magenta, and black corresponding to color separation components of a color image (e.g., yellow, cyan, magenta, and black toners), respectively, the image forming devices 4Y, 4C, 4M, and 4K have an identical structure.

For example, each of the image forming devices 4Y, 4C, 4M, and 4K, serving as an image forming station, includes a drum-shaped photoconductor 5 serving as a latent image bearer or an image bearer that bears an electrostatic latent image and a resultant toner image; a charger 6 that charges an outer circumferential surface of the photoconductor 5; a developing device 7 that supplies toner to the electrostatic latent image formed on the outer circumferential surface of the photoconductor 5, thus visualizing the electrostatic latent image as a toner image; and a cleaner 8 that cleans the outer circumferential surface of the photoconductor 5. FIG. 1 illustrates reference numerals assigned to the photoconductor 5, the charger 6, the developing device 7, and the cleaner 8 of the image forming device 4K that forms a black toner image. However, reference numerals for the image forming devices 4Y, 4C, and 4M that form yellow, cyan, and magenta toner images, respectively, are omitted.

Below the image forming devices 4Y, 4C, 4M, and 4K is an exposure device 9 that exposes the outer circumferential surface of the respective photoconductors 5 with laser beams. For example, the exposure device 9, constructed of a light source, a polygon mirror, an f-θ lens, reflection mirrors, and the like, emits a laser beam onto the outer circumferential surface of the respective photoconductors 5 according to image data sent from an external device such as a client computer.

Above the image forming devices 4Y, 4C, 4M, and 4K is a transfer device 3. For example, the transfer device 3 includes the intermediate transfer belt 30 serving as a transferor or a transferred image bearer, four primary transfer rollers 31 serving as primary transferors, and a secondary transfer roller 36 serving as a secondary transferor. The transfer device 3 further includes a secondary transfer backup roller 32, a cleaning backup roller 33, a tension roller 34, and a belt cleaner 35.

The intermediate transfer belt 30 is an endless belt stretched taut across the secondary transfer backup roller 32, the cleaning backup roller 33, and the tension roller 34. As a driver drives and rotates the secondary transfer backup roller 32 counterclockwise in FIG. 1, the secondary transfer backup roller 32 rotates the intermediate transfer belt 30 counterclockwise in FIG. 1 in a rotation direction D30 by friction therebetween.

The four primary transfer rollers 31 sandwich the intermediate transfer belt 30 together with the four photoconductors 5, forming four primary transfer nips between the intermediate transfer belt 30 and the photoconductors 5, respectively. The primary transfer rollers 31 are coupled to a power supply disposed inside the image forming apparatus 1. The power supply applies at least one of a predetermined direct current (DC) voltage and a predetermined alternating current (AC) voltage to each of the primary transfer rollers 31.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31, the secondary transfer roller 36 is coupled to the power supply disposed inside the image forming apparatus 1. The power supply applies at least one of a predetermined direct current (DC) voltage and a predetermined alternating current (AC) voltage to the secondary transfer roller 36.

The belt cleaner 35 includes a cleaning brush and a cleaning blade that contact an outer circumferential surface of the intermediate transfer belt 30.

A bottle holder 2 situated in an upper portion of the image forming apparatus 1 accommodates four toner bottles 2Y, 2C, 2M, and 2K detachably attached to the bottle holder 2. The toner bottles 2Y, 2C, 2M, and 2K contain fresh yellow, cyan, magenta, and black toners to be supplied to the developing devices 7 of the image forming devices 4Y, 4C, 4M, and 4K, respectively. For example, the fresh yellow, cyan, magenta, and black toners are supplied from the toner bottles 2Y, 2C, 2M, and 2K to the developing devices 7 through toner supply tubes interposed between the toner bottles 2Y, 2C, 2M, and 2K and the developing devices 7, respectively.

In a lower portion of the image forming apparatus 1 are a paper tray 10 that loads a plurality of sheets P serving as recording media and a feed roller 11 that picks up and feeds a sheet P from the paper tray 10 toward the secondary transfer nip formed between the secondary transfer roller 36 and the intermediate transfer belt 30. The sheets P may be thick paper, postcards, envelopes, plain paper, thin paper, coated paper, art paper, tracing paper, overhead projector (OHP) transparencies, and the like. Optionally, a bypass tray that loads thick paper, postcards, envelopes, thin paper, coated paper, art paper, tracing paper, OHP transparencies, and the like may be attached to the image forming apparatus 1.

A conveyance path R extends from the feed roller 11 to an output roller pair 13 to convey the sheet P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a sheet conveyance direction DP. The registration roller pair 12 serving as a conveyor conveys the sheet P conveyed from the feed roller 11 toward the secondary transfer nip.

The conveyance path R is further provided with a fixing device 20 located above the secondary transfer nip, that is, downstream from the secondary transfer nip in the sheet conveyance direction DP. The fixing device 20 fixes an unfixed toner image, which is transferred from the intermediate transfer belt 30 onto the sheet P, on the sheet P. The conveyance path R is further provided with the output roller pair 13 located above the fixing device 20, that is, downstream from the fixing device 20 in the sheet conveyance direction DP. The output roller pair 13 ejects the sheet P bearing the fixed toner image onto the outside of the image forming apparatus 1, that is, an output tray 14 disposed atop the image forming apparatus 1. The output tray 14 stocks the sheet P ejected by the output roller pair 13.

Referring to FIG. 1, a description is provided of an image forming operation performed by the image forming apparatus 1 having the construction described above to form a full color toner image on a sheet P.

As a print job starts, a driver drives and rotates the photoconductors 5 of the image forming devices 4Y, 4C, 4M, and 4K, respectively, clockwise in FIG. 1 in a rotation direction D5. The chargers 6 uniformly charge the outer circumferential surface of the respective photoconductors 5 at a predetermined polarity. The exposure device 9 emits laser beams onto the charged outer circumferential surface of the respective photoconductors 5 according to yellow, cyan, magenta, and black image data constructing color image data sent from the external device, respectively, thus forming electrostatic latent images on the photoconductors 5. The image data used to expose the respective photoconductors 5 is monochrome image data produced by decomposing a desired full color image into yellow, cyan, magenta, and black image data. The developing devices 7 supply yellow, cyan, magenta, and black toners to the electrostatic latent images formed on the photoconductors 5, visualizing the electrostatic latent images as yellow, cyan, magenta, and black toner images, respectively.

Simultaneously, as the print job starts, the secondary transfer backup roller 32 is driven and rotated counterclockwise in FIG. 1, rotating the intermediate transfer belt 30 in the rotation direction D30 by friction therebetween. The power supply applies a constant voltage or a constant current control voltage having a polarity opposite a polarity of the charged toner to the primary transfer rollers 31, creating a transfer electric field at each of the primary transfer nips formed between the photoconductors 5 and the primary transfer rollers 31, respectively.

When the yellow, cyan, magenta, and black toner images formed on the photoconductors 5 reach the primary transfer nips, respectively, in accordance with rotation of the photoconductors 5, the yellow, cyan, magenta, and black toner images are primarily transferred from the photoconductors 5 onto the intermediate transfer belt 30 by the transfer electric field created at the primary transfer nips such that the yellow, cyan, magenta, and black toner images are superimposed successively on a same position on the intermediate transfer belt 30. Thus, a full color toner image is formed on the outer circumferential surface of the intermediate transfer belt 30. After the primary transfer of the yellow, cyan, magenta, and black toner images from the photoconductors 5 onto the intermediate transfer belt 30, the cleaners 8 remove residual toner failed to be transferred onto the intermediate transfer belt 30 and therefore remaining on the photoconductors 5 therefrom, respectively. Thereafter, dischargers discharge the outer circumferential surface of the respective photoconductors 5, initializing the surface potential thereof.

On the other hand, the feed roller 11 disposed in the lower portion of the image forming apparatus 1 is driven and rotated to feed a sheet P from the paper tray 10 toward the registration roller pair 12 through the conveyance path R. The registration roller pair 12 conveys the sheet P sent to the conveyance path R by the feed roller 11 to the secondary transfer nip formed between the secondary transfer roller 36 and the intermediate transfer belt 30 at a proper time. The secondary transfer roller 36 is applied with a transfer voltage having a polarity opposite a polarity of the charged yellow, cyan, magenta, and black toners constructing the full color toner image formed on the intermediate transfer belt 30, thus creating a transfer electric field at the secondary transfer nip.

As the yellow, cyan, magenta, and black toner images constructing the full color toner image on the intermediate transfer belt 30 reach the secondary transfer nip in accordance with rotation of the intermediate transfer belt 30, the transfer electric field created at the secondary transfer nip secondarily transfers the yellow, cyan, magenta, and black toner images from the intermediate transfer belt 30 onto the sheet P collectively. After the secondary transfer of the full color toner image from the intermediate transfer belt 30 onto the sheet P, the belt cleaner 35 removes residual toner failed to be transferred onto the sheet P and therefore remaining on the intermediate transfer belt 30 therefrom. The removed toner is conveyed and collected into a waste toner container situated inside the image forming apparatus 1.

Thereafter, the sheet P bearing the full color toner image is conveyed to the fixing device 20 that fixes the full color toner image on the sheet P. Thereafter, the sheet P bearing the fixed full color toner image is ejected by the output roller pair 13 onto the outside of the image forming apparatus 1, that is, the output tray 14 that stocks the sheet P.

The above describes the image forming operation of the image forming apparatus 1 to form the full color toner image on the sheet P. Alternatively, the image forming apparatus 1 may form a monochrome toner image by using any one of the four image forming devices 4Y, 4C, 4M, and 4K or may form a bicolor toner image or a tricolor toner image by using two or three of the image forming devices 4Y, 4C, 4M, and 4K.

Figure 2:
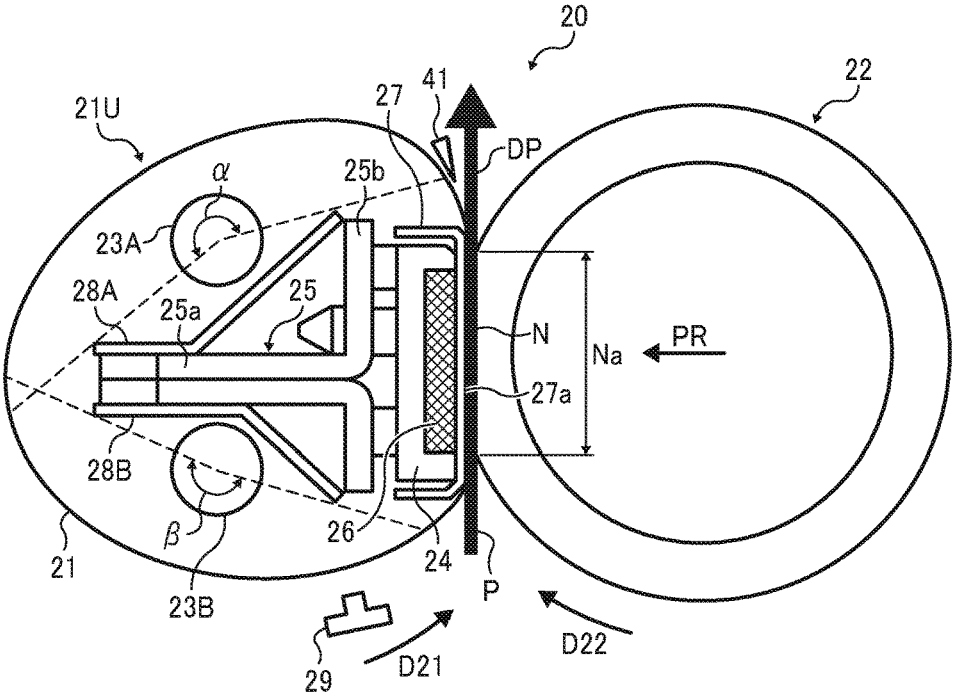
FIG. 2 is a vertical cross-sectional view of a fixing device incorporated in the image forming apparatus depicted in FIG. 1.

Referring to FIG. 2, a description is provided of a construction of the fixing device 20 incorporated in the image forming apparatus 1 having the construction described above.

FIG. 2 is a schematic vertical cross-sectional view of the fixing device 20. The fixing device 20 (e.g., a fuser or a fusing unit) includes a fixing belt 21 and a pressure roller 22. The fixing belt 21, serving as a fixing rotator or a fixing member, is an endless belt that is thin, flexible, tubular, and rotatable in a rotation direction D21. The pressure roller 22, serving as a pressure rotator or a pressure member, contacts an outer circumferential surface of the fixing belt 21. The pressure roller 22 is rotatable in a rotation direction D22. Inside a loop formed by the fixing belt 21 is a plurality of heaters or a plurality of fixing heaters, that is, a halogen heater 23A serving as a first radiant heater and a halogen heater 23B serving as a second radiant heater, that heats the fixing belt 21 with radiant heat. Each of the halogen heaters 23A and 23B is a radiant heater serving as a main heater or a fixing heater.

Inside the loop formed by the fixing belt 21 are a nip formation pad 24, a stay 25, lateral end heaters 26, a thermal conduction aid 27, and reflectors 28A and 28B. The components disposed inside the loop formed by the fixing belt 21, that is, the halogen heaters 23A and 23B, the nip formation pad 24, the stay 25, the lateral end heaters 26, the thermal conduction aid 27, and the reflectors 28A and 28B, may construct a belt unit 21U separably coupled with the pressure roller 22. The nip formation pad 24 presses against the pressure roller 22 via the fixing belt 21 to form a fixing nip N between the fixing belt 21 and the pressure roller 22. The stay 25, serving as a support, supports the nip formation pad 24.

A detailed description is now given of a configuration of the nip formation pad 24.

The nip formation pad 24 extending in a longitudinal direction thereof parallel to an axial direction of the fixing belt 21 is secured to and supported by the stay 25. Accordingly, even if the nip formation pad 24 receives pressure from the pressure roller 22, the stay 25 prevents the nip formation pad 24 from being bent by the pressure and therefore allows the nip formation pad 24 to produce a uniform nip length throughout the entire width of the pressure roller 22 in an axial direction or a longitudinal direction thereof. The nip formation pad 24 is made of a heat resistant material being resistant against temperatures up to 200 degrees centigrade and having an enhanced mechanical strength. For example, the nip formation pad 24 is made of heat resistant resin such as polyimide (PI), polyether ether ketone (PEEK), and PI or PEEK reinforced with glass fiber. Thus, the nip formation pad 24 is immune from thermal deformation at temperatures in a fixing temperature range desirable to fix a toner image on a sheet P, retaining the shape of the fixing nip N and quality of the toner image formed on the sheet P.

Both lateral ends of the stay 25 and the halogen heaters 23A and 23B in a longitudinal direction thereof are secured to and supported by a pair of side plates of the fixing device 20 or a pair of holders, provided separately from the pair of side plates, respectively.

A detailed description is now given of a configuration of the lateral end heaters 26.

The lateral end heaters 26 are mounted on or coupled with both lateral ends of the nip formation pad 24 in the longitudinal direction thereof, respectively. The lateral end heaters 26 serve as a sub heater provided separately from the main heater or the fixing heater (e.g., the halogen heaters 23A and 23B). The lateral end heaters 26 heat both lateral ends of the fixing belt 21 in the axial direction thereof, respectively. The lateral end heater 26 is a contact heater that contacts the thermal conduction aid 27 to conduct heat to the fixing belt 21, for example, a resistive heat generator such as a ceramic heater.

A detailed description is now given of a configuration of the thermal conduction aid 27.

The thermal conduction aid 27 also serves as a thermal equalizer that decreases a temperature gradient of the fixing belt 21 in the axial direction thereof. The thermal conduction aid 27 covers a belt-side face of each of the nip formation pad 24 and the lateral end heaters 26, which is disposed opposite an inner circumferential surface of the fixing belt 21. The thermal conduction aid 27 conducts and equalizes heat in a longitudinal direction of the thermal conduction aid 27 that is parallel to the axial direction of the fixing belt 21, preventing heat from being stored at both lateral ends of the fixing belt 21 in the axial direction thereof while a plurality of small sheets P is conveyed over the fixing belt 21 or while the lateral end heaters 26 are turned on. Thus, the thermal conduction aid 27 eliminates uneven temperature of the fixing belt 21 in the axial direction thereof. Hence, the thermal conduction aid 27 is made of a material that conducts heat quickly, for example, a material having an enhanced thermal conductivity such as copper and aluminum.

The thermal conduction aid 27 includes a belt-side face 27*a* being disposed opposite and in direct contact with the inner circumferential surface of the fixing belt 21, thus serving as a nip formation face that forms the fixing nip N. As illustrated in FIG. 2, the belt-side face 27*a* is planar. Alternatively, the belt-side face 27*a* may be curved or recessed or may have other shapes. If the belt-side face 27*a* is recessed with respect to the pressure roller 22, the belt-side face 27*a* directs a leading edge of the sheet P toward the pressure roller 22 as the sheet P is ejected from the fixing nip N, facilitating separation of the sheet P from the fixing belt 21 and suppressing jamming of the sheet P between the fixing belt 21 and the pressure roller 22.

A temperature sensor 29 is disposed opposite the outer circumferential surface of the fixing belt 21 at a proper position thereon, for example, a position upstream from the fixing nip N in the rotation direction D21 of the fixing belt 21. The temperature sensor 29 detects a temperature of the fixing belt 21. A separator 41 is disposed downstream from the fixing nip N in the sheet conveyance direction DP to separate the sheet P from the fixing belt 21. A pressurization assembly presses the pressure roller 22 against the nip formation pad 24 via the fixing belt 21 and releases pressure exerted by the pressure roller 22 to the fixing belt 21.

A detailed description is now given of a construction of the fixing belt 21.

In order to decrease a thermal capacity of the fixing belt 21, the fixing belt 21, that is, an endless belt being thin like film and having a downsized loop diameter, is constructed of a base layer serving as the inner circumferential surface of the fixing belt 21 and a release layer serving as the outer circumferential surface of the fixing belt 21. The base layer is made of metal such as nickel and SUS stainless steel or resin such as PI. The release layer is made of tetrafluoroethylene-perfluoroalkylvinylether copolymer (PFA), polytetrafluoroethylene (PTFE), or the like. Optionally, an elastic layer made of rubber such as silicone rubber, silicone rubber foam, and fluoro rubber may be interposed between the base layer and the release layer.

While the fixing belt 21 and the pressure roller 22 pressingly sandwich the unfixed toner image on the sheet P to fix the toner image on the sheet P, the elastic layer having a thickness of about 100 micrometers elastically deforms to absorb slight surface asperities of the fixing belt 21, preventing variation in gloss of the toner image on the sheet P. In order to decrease the thermal capacity of the fixing belt 21, the fixing belt 21 has a total thickness not greater than 1 mm and a loop diameter in a range of from 20 mm to 40 mm. For example, the fixing belt 21 is constructed of the base layer having a thickness in a range of from 20 micrometers to 50 micrometers; the elastic layer having a thickness in a range of from 100 micrometers to 300 micrometers; and the release layer having a thickness in a range of from 10 micrometers to 50 micrometers. In order to decrease the thermal capacity of the fixing belt 21 further, the fixing belt 21 may have a total thickness not greater than 0.20 mm and preferably not greater than 0.16 mm. The loop diameter of the fixing belt 21 is not greater than 30 mm.

A detailed description is now given of a construction of the stay 25.

The stay 25, having a T-shape in cross-section, includes a base 25*b* disposed opposite the fixing nip N and an arm 25*a* projecting from the base 25*b* and being disposed opposite the nip formation pad 24 via the base 25*b*. In other words, the arm 25*a* of the stay 25 projects from the nip formation pad 24 in a pressurization direction PR in which the pressure roller 22 presses against the nip formation pad 24 via the fixing belt 21. The arm 25*a* is interposed between the halogen heaters 23A and 23B serving as the main heater to screen the halogen heater 23A from the halogen heater 23B.

A detailed description is now given of a construction of the halogen heaters 23A and 23B.

The halogen heater 23A includes a center heat generator disposed in a center span of the halogen heater 23A in the longitudinal direction thereof. A small sheet P is disposed opposite the center heat generator of the halogen heater 23A. The halogen heater 23B includes a lateral end heat generator disposed in each lateral end span of the halogen heater 23B in the longitudinal direction thereof. A large sheet P is disposed opposite the lateral end heat generator of the halogen heater 23B. The power supply situated inside the image forming apparatus 1 supplies power to the halogen heaters 23A and 23B so that the halogen heaters 23A and 23B generate heat. A controller operatively connected to the halogen heaters 23A and 23B and the temperature sensor 29 controls the halogen heaters 23A and 23B based on the temperature of the outer circumferential surface of the fixing belt 21, which is detected by the temperature sensor 29 disposed opposite the outer circumferential surface of the fixing belt 21. Thus, the temperature of the fixing belt 21 is adjusted to a desired fixing temperature.

A detailed description is now given of a configuration of the reflectors 28A and 28B.

The reflector 28A is interposed between the halogen heater 23A and the stay 25. The reflector 28B is interposed between the halogen heater 23B and the stay 25. The reflectors 28A and 28B reflect light and heat radiated from the halogen heaters 23A and 23B to the reflectors 28A and 28B, respectively, toward the fixing belt 21, thus enhancing heating efficiency of the halogen heaters 23A and 23B to heat the fixing belt 21. Additionally, the reflectors 28A and 28B prevent light and heat radiated from the halogen heaters 23A and 23B from heating the stay 25 with radiant heat, suppressing waste of energy. Alternatively, instead of the reflectors 28A and 28B, an opposed face of the stay 25 disposed opposite the halogen heaters 23A and 23B may be treated with insulation or mirror finish to reflect light and heat radiated from the halogen heaters 23A and 23B to the stay 25 toward the fixing belt 21.

A detailed description is now given of a construction of the pressure roller 22.

The pressure roller 22 is constructed of a core bar; an elastic layer coating the core bar and being made of silicone rubber foam, fluoro rubber, or the like; and a release layer coating the elastic layer and being made of PFA, PTFE, or the like. The pressurization assembly such as a spring presses the pressure roller 22 against the fixing belt 21 to form the fixing nip N. The pressure roller 22 pressingly contacting the fixing belt 21 deforms the elastic layer of the pressure roller 22 at the fixing nip N formed between the pressure roller 22 and the fixing belt 21, thus defining the fixing nip N having a predetermined length in the sheet conveyance direction DP.

A driver (e.g., a motor) disposed inside the image forming apparatus 1 depicted in FIG. 1 drives and rotates the pressure roller 22. As the driver drives and rotates the pressure roller 22, a driving force of the driver is transmitted from the pressure roller 22 to the fixing belt 21 at the fixing nip N, thus rotating the fixing belt 21 in accordance with rotation of the pressure roller 22 by friction between the pressure roller 22 and the fixing belt 21. Alternatively, the driver may also be connected to the fixing belt 21 to drive and rotate the fixing belt 21. In a nip span Na of the fixing nip N, the fixing belt 21 rotates as the fixing belt 21 is sandwiched between the pressure roller 22 and the nip formation pad 24; in a circumferential span of the fixing belt 21 other than the nip span Na, the fixing belt 21 rotates while the fixing belt 21 is guided by flanges secured to the pair of side plates at both lateral ends of the fixing belt 21 in the axial direction thereof, respectively.

According to this exemplary embodiment, the pressure roller 22 is a solid roller. Alternatively, the pressure roller 22 may be a hollow roller. In this case, a heater such as a halogen heater may be disposed inside the hollow roller. The elastic layer of the pressure roller 22 may be made of solid rubber. Alternatively, if no heater is situated inside the pressure roller 22, the elastic layer of the pressure roller 22 may be made of sponge rubber. The sponge rubber is more preferable than the solid rubber because the sponge rubber has an increased insulation that draws less heat from the fixing belt 21.

Figure 3:
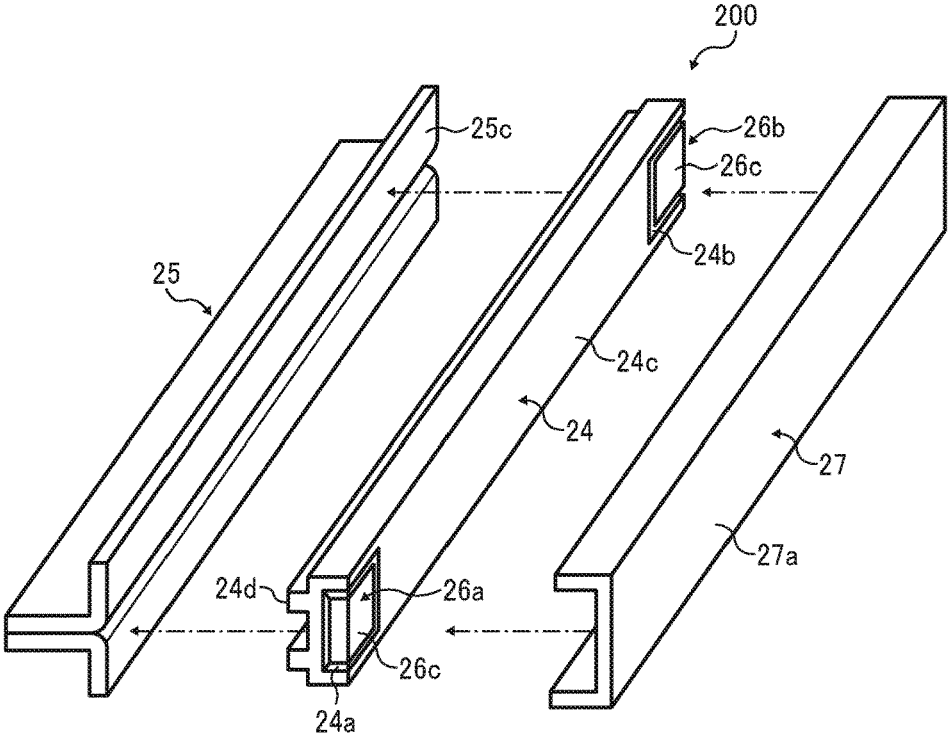
FIG. 3 is a perspective view of a nip formation unit incorporated in the fixing device depicted in FIG. 2.

Referring to FIG. 3, a description is provided of a construction of a nip formation unit 200 incorporated in the fixing device 20 depicted in FIG. 2.

FIG. 3 is a perspective view of the nip formation unit 200, illustrating a basic structure of the nip formation unit 200. As illustrated in FIG. 3, the nip formation unit 200 includes the nip formation pad 24, the stay 25, the thermal conduction aid 27, and lateral end heaters 26*a* and 26*b* illustrated as the lateral end heaters 26 in FIG. 2.

Each of the lateral end heaters 26*a* and 26*b* includes a belt-side face 26*c* disposed opposite the inner circumferential surface of the fixing belt 21. The nip formation pad 24 includes a belt-side face 24*c* being disposed opposite the fixing nip N and the inner circumferential surface of the fixing belt 21 and a stay-side face 24*d* being opposite the belt-side face 24*c* and disposed opposite the stay 25. The stay 25 includes a belt-side face 25*c* being planar and disposed opposite the fixing nip N and the inner circumferential surface of the fixing belt 21.

The stay-side face 24*d* of the nip formation pad 24 contacts the belt-side face 25*c* of the stay 25. For example, the stay-side face 24*d* of the nip formation pad 24 and the belt-side face 25*c* of the stay 25 mount a recess and a projection (e.g., a boss and a pin), respectively, so that the stay-side face 24*d* engages the belt-side face 25*c* to restrict each other with the shape of the stay-side face 24*d* and the belt-side face 25*c*. The thermal conduction aid 27 engages the nip formation pad 24 that is substantially rectangular such that the thermal conduction aid 27 covers the belt-side face 24*c* of the nip formation pad 24 that is disposed opposite the inner circumferential surface of the fixing belt 21. Thus, the thermal conduction aid 27 is coupled with the nip formation pad 24. For example, the thermal conduction aid 27 is coupled with the nip formation pad 24 with a claw, an adhesive, or the like.

Two recesses 24*a* and 24*b*, each of which defines a step or a difference in thickness of the nip formation pad 24, are disposed at both lateral ends of the nip formation pad 24 in the longitudinal direction thereof, respectively. The lateral end heaters 26*a* and 26*b* are secured to the recesses 24*a* and 24*b*, thus being accommodated by the recesses 24*a* and 24*b*, respectively. A description of a positional relation between the lateral end heaters 26*a* and 26*b* and the halogen heaters 23A and 23B is deferred.

The thermal conduction aid 27 includes the belt-side face 27*a* that is disposed opposite the inner circumferential surface of the fixing belt 21. The belt-side face 27*a* serves as a slide face over which the fixing belt 21 slides. However, since the belt-side face 24*c* of the nip formation pad 24 has a mechanical strength greater than that of the belt-side face 27*a* of the thermal conduction aid 27, the belt-side face 24*c* of the nip formation pad 24 serves as a nip formation face that is disposed opposite the pressure roller 22 and forms the fixing nip N practically.

Figure 4:
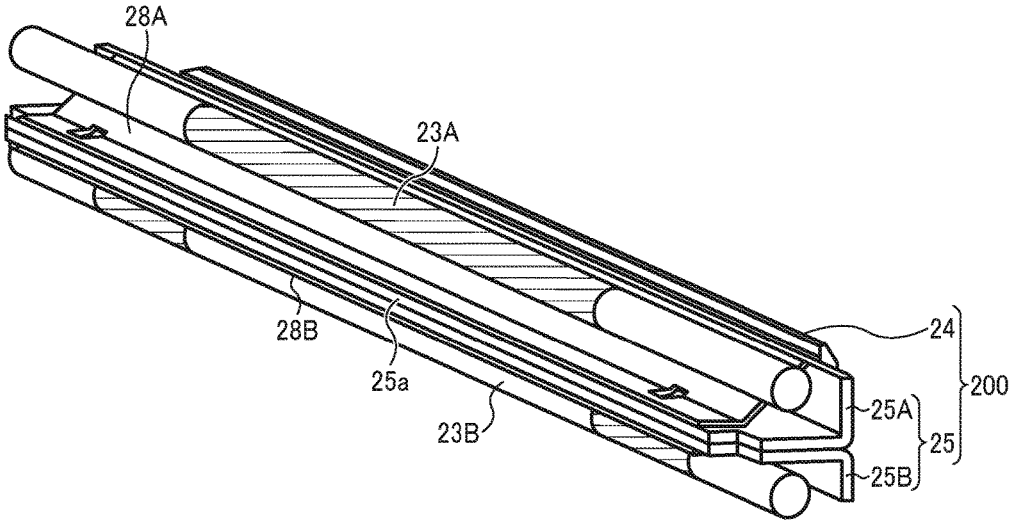
FIG. 4 is a perspective view of the nip formation unit depicted in FIG. 3 and halogen heaters incorporated in the fixing device depicted in FIG. 2.

FIG. 4 is a perspective view of the nip formation unit 200 and the halogen heaters 23A and 23B. As illustrated in FIG. 4, the stay 25 includes a first portion 25A and a second portion 25B, each of which is substantially L-shaped in cross-section. Thus, the stay 25 is substantially T-shaped in cross-section. Accordingly, the stay 25 attains an enhanced rigidity that prevents the nip formation pad 24 from being bent by pressure from the pressure roller 22. The stay 25 constructed of the first portion 25A and the second portion 25B extends linearly in the longitudinal direction of the nip formation pad 24. The stay 25 is secured to the nip formation pad 24. Accordingly, the stay 25 renders the belt-side face 24*c* depicted in FIG. 3 of the nip formation pad 24 to form the fixing nip N precisely throughout the entire width of the fixing nip N in the longitudinal direction of the nip formation pad 24.

As illustrated in FIG. 4, the halogen heater 23A is disposed opposite the halogen heater 23B via the arm 25*a* of the stay 25 in a short direction perpendicular to the longitudinal direction of the stay 25. The arm 25*a* is interposed between the halogen heaters 23A and 23B to screen the halogen heater 23A from the halogen heater 23B. Accordingly, while the halogen heaters 23A and 23B are powered on, glass tubes of the halogen heaters 23A and 23B, respectively, do not heat each other, preventing degradation in heating efficiency of the halogen heaters 23A and 23B. As illustrated in FIG. 2, each of the halogen heaters 23A and 23B is not surrounded by the stay 25. For example, a center of each of the halogen heaters 23A and 23B in cross-section is outside a space defined or enclosed by the stay 25. Accordingly, the halogen heaters 23A and 23B attain obtuse irradiation angles $\alpha$ and $\beta$, respectively, of light that irradiates the fixing belt 21, thus improving heating efficiency.

Alternatively, the stay 25 may have shapes other than the substantially T-shape in cross-section. The first portion 25A and the second portion 25B depicted in FIG. 4 may curve and extend in the longitudinal direction of the halogen heaters 23A and 23B as long as the arm 25*a* interposed between the halogen heaters 23A and 23B screens the halogen heater 23A from the halogen heater 23B. The arm 25*a* of each of the first portion 25A and the second portion 25B may be oblique relative to the belt-side face 24*c* of the nip formation pad 24.

A description is provided of arrangement of the lateral end heaters 26*a* and 26*b* to correspond to sheets P of special sizes such as an A3 extension size sheet.

Figure 5:
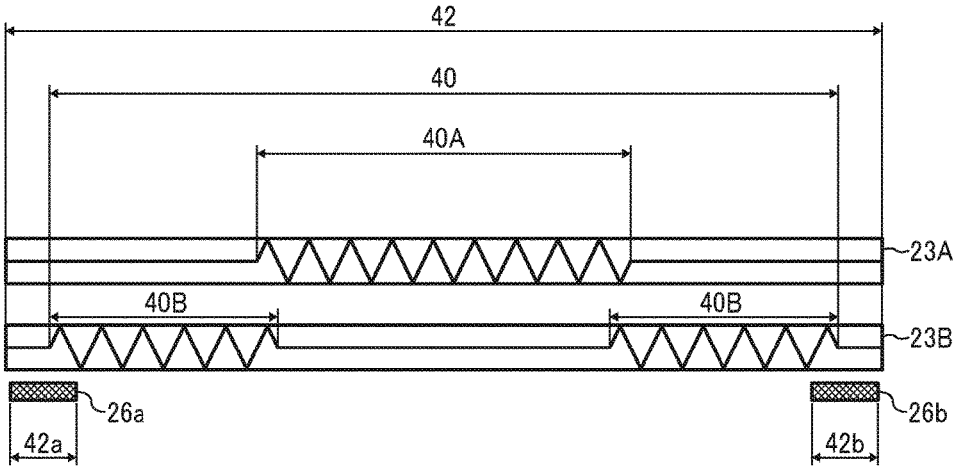
FIG. 5 is a diagram of the halogen heaters depicted in FIG. 4 and lateral end heaters incorporated in the nip formation unit depicted in FIG. 3.

FIG. 5 is a diagram of the halogen heaters 23A and 23B and the lateral end heaters 26*a* and 26*b*, illustrating arrangement thereof. As illustrated in FIG. 5, the halogen heater 23A includes a heat generator 40A serving as a center heat generator having a dense light distribution in the center span of the halogen heater 23A, which is disposed opposite a center span of the fixing belt 21 in the axial direction thereof. The halogen heater 23B includes a heat generator 40B serving as a lateral end heat generator having a dense light distribution in each lateral end span of the halogen heater 23B, which is disposed opposite each lateral end span of the fixing belt 21 in the axial direction thereof. The heat generator 40B is disposed outboard from the heat generator 40A in the axial direction of the fixing belt 21. The halogen heater 23A heats the center span of the fixing belt 21 in the axial direction thereof. The halogen heater 23B heats each lateral end span of the fixing belt 21 in the axial direction thereof.

The heat generator 40A of the halogen heater 23A corresponds to small sheets P of small sizes such as an A4 size sheet in portrait orientation. The heat generator 40B of the halogen heater 23B corresponds to large sheets P of large sizes such as an A3 size sheet in portrait orientation. The heat generator 40B is disposed outboard from the heat generator 40A in the longitudinal direction of the halogen heater 23A so that the heat generator 40B heats a lateral end of the large sheet P that is outboard from the heat generator 40A in the longitudinal direction of the halogen heater 23B. The large sheets P include a maximum standard size sheet available in the fixing device 20. A heat generator 40, that is, a first combined heat generator constructed of or defined by the heat generators 40A and 40B, corresponds to a width of the maximum standard size sheet (e.g., the A3 size sheet in portrait orientation) and does not encompass a width of an extra-large sheet P of an extension size, which is greater than the width of the maximum standard size sheet.

The lateral end heaters 26*a* and 26*b* are disposed opposite both lateral ends of the halogen heater 23B in the longitudinal direction thereof, respectively. The lateral end heaters 26*a* and 26*b* include heat generators 42*a* and 42*b* that heat both lateral ends of the extra-large sheet P greater than the maximum standard size sheet in the longitudinal direction of the halogen heater 23B, respectively. Thus, a heat generator 42, that is, a second combined heat generator constructed of or defined by the heat generators 40A, 40B, 42*a*, and 42*b*, corresponds to the width of the extra-large sheet P of the extension size (e.g., an A3 extension size sheet and a 13-inch sheet). A part of each of the heat generators 42*a* and 42*b* overlaps the heat generator 40B in the longitudinal direction of the halogen heater 23B. Accordingly, the fixing belt 21 of the fixing device 20 heats both lateral ends of the extra-large sheet P greater than the maximum standard size sheet in the longitudinal direction of the halogen heater 23B.

A description is provided of an amount of heat output by the halogen heaters 23A and 23B and the lateral end heaters 26*a* and 26*b* to heat the fixing belt 21.

Figure 6:
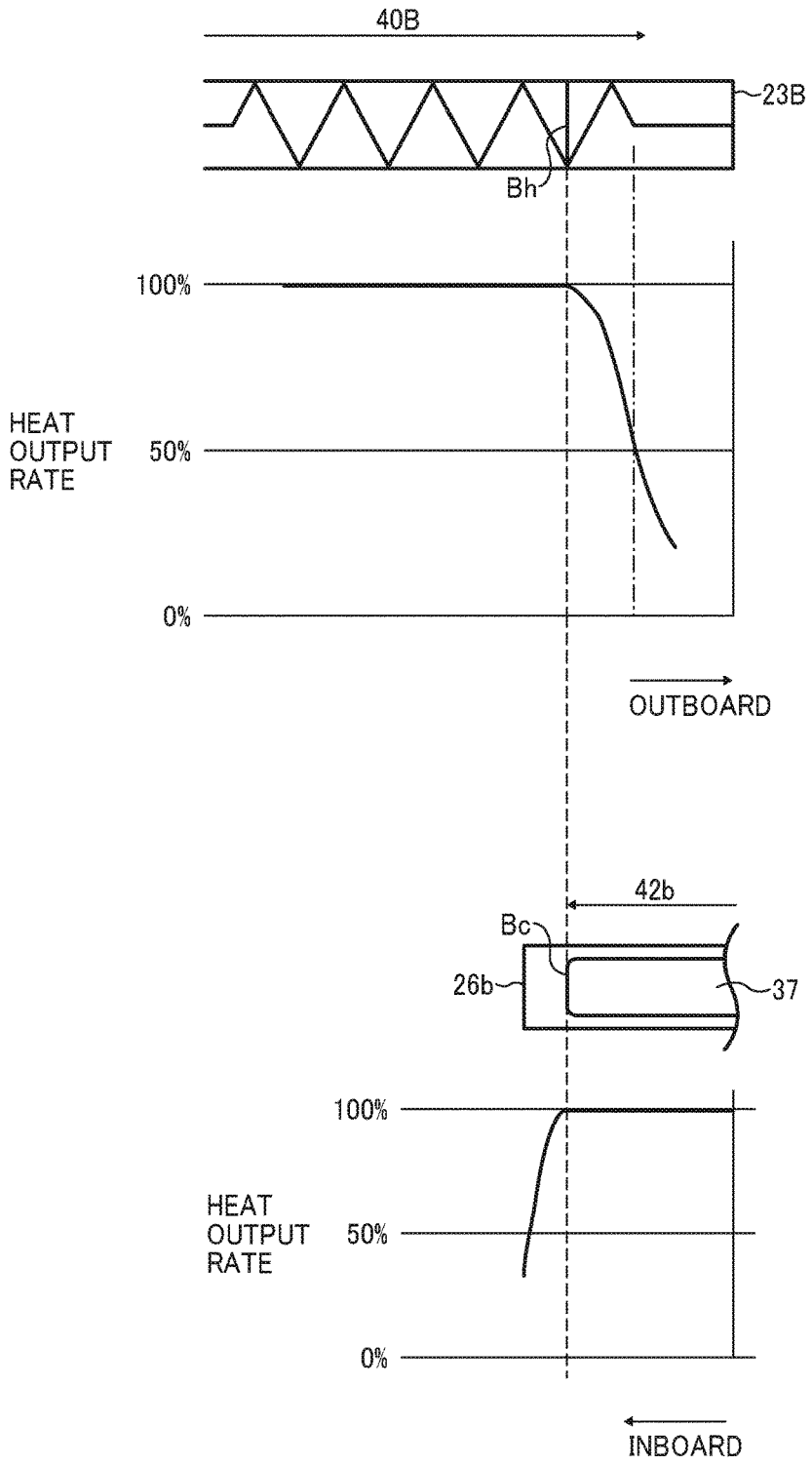
FIG. 6 is a diagram illustrating a positional relation between a heat generator of the halogen heater and a heat generator of the lateral end heater depicted in FIG. 5 and a heat output rate of heat output from the heat generators.

FIG. 6 is a diagram illustrating a positional relation between the heat generator 40B of the halogen heater 23B and the heat generator 42*b* of the lateral end heater 26*b* and a heat output rate of the heat generators 40B and 42*b*. An upper part of FIG. 6 illustrates a right lateral end of the heat generator 40B of the halogen heater 23B. A lower part of FIG. 6 illustrates a left lateral end of the heat generator 42*b* of the lateral end heater 26*b*.

Generally, a heat generator, in which a filament is coiled helically, of a halogen heater suffers from decrease in heat output at a lateral end of the heat generator in a longitudinal direction of the halogen heater. The decrease in heat output varies depending on a density of the filament coiled helically. The smaller the density of the filament coiled helically, the more the halogen heater is susceptible to the decrease in heat output. As illustrated in the upper part in FIG. 6, a lateral end of the heat generator 40B in the longitudinal direction of the halogen heater 23B, which suffers from the decrease in heat output, is defined as a span from a position at which the heat generator 40B attains a predetermined heat output rate of 100 percent to a position at which the heat generator 40B suffers from a decreased heat output rate of 50 percent.

As illustrated in the lower part in FIG. 6, the heat generator 42*b* includes a heat generation pattern 37. A lateral end of the lateral end heater 26*b* that is inboard from the heat generator 42*b* in a longitudinal direction of the lateral end heater 26*b* suffers from the decrease in heat output. The lateral end of the lateral end heater 26*b* in the longitudinal direction thereof fails to attain the predetermined heat output rate of 100 percent and suffers from a decreased heat output rate.

Accordingly, as the lateral end of the halogen heater 23B and the lateral end heater 26*b* in the longitudinal direction thereof suffers from the decrease in heat output, a toner image formed on the lateral end of the extra-large sheet P greater than the maximum standard size sheet may not be fixed on the extra-large sheet P properly.

To address this circumstance, a border Bh at which heat output from the heat generator 40B of the halogen heater 23B starts decreasing corresponds to a border Bc at which heat output from the heat generator 42*b* of the lateral end heater 26*b* starts decreasing. Since the halogen heater 23B is spaced apart from the lateral end heater 26*b* as illustrated in FIG. 2, the border Bh coincides with the border Bc in the longitudinal direction of the halogen heater 23B on a projection. Similarly, the border Bh at which heat output from another heat generator 40B of the halogen heater 23B starts decreasing corresponds to the border Bc at which heat output from the heat generator 42*a* of the lateral end heater 26*a* depicted in FIG. 5 starts decreasing.

Accordingly, the heat generator 42 depicted in FIG. 5 is immune from decrease in heat output in an overlap span where the heat generator 40B of the halogen heater 23B overlaps the lateral end heater 26*a* and an overlap span where the heat generator 40B of the halogen heater 23B overlaps the lateral end heater 26*b* in the longitudinal direction of the halogen heater 23B, thus retaining the predetermined heat output rate of 100 percent. Consequently, even when the extra-large sheet P greater than the maximum standard size sheet is conveyed over the fixing belt 21, the toner image formed on each lateral end of the extra-large sheet P in a width direction of the extra-large sheet P is fixed on the extra-large sheet P properly.

As illustrated in FIG. 6, the border Bh at which heat output from the heat generator 40B of the halogen heater 23B starts decreasing coincides with the border Bc at which heat output from the heat generator 42*b* of the lateral end heater 26*b* starts decreasing. However, as illustrated in FIG. 3, the nip formation unit 200 incorporates the thermal conduction aid 27 having an enhanced thermal conductivity that offsets a certain amount of decrease in heat output from the heat generators 40B and 42*b* and therefore equalizes the temperature of the fixing belt 21. Hence, the position of the border Bc at which heat output from the heat generators 42*a* and 42*b* of the lateral end heaters 26*a* and 26*b*, respectively, starts decreasing may be determined within a predetermined allowable range.

A description is provided of positioning of the border Bc, that is, an inboard lateral edge of the heat generator 42*b* of the lateral end heater 26*b* in the longitudinal direction of the lateral end heater 26*b*, at which heat output from the heat generator 42*b* starts decreasing.

Referring to graphs illustrating heat output from the halogen heaters 23A and 23B, positioning of the border Bc is explained with three patterns. The position of the border Bc is determined within the predetermined allowable range.

A description is provided of a first pattern of positioning of the border Bc.

Figure 7:
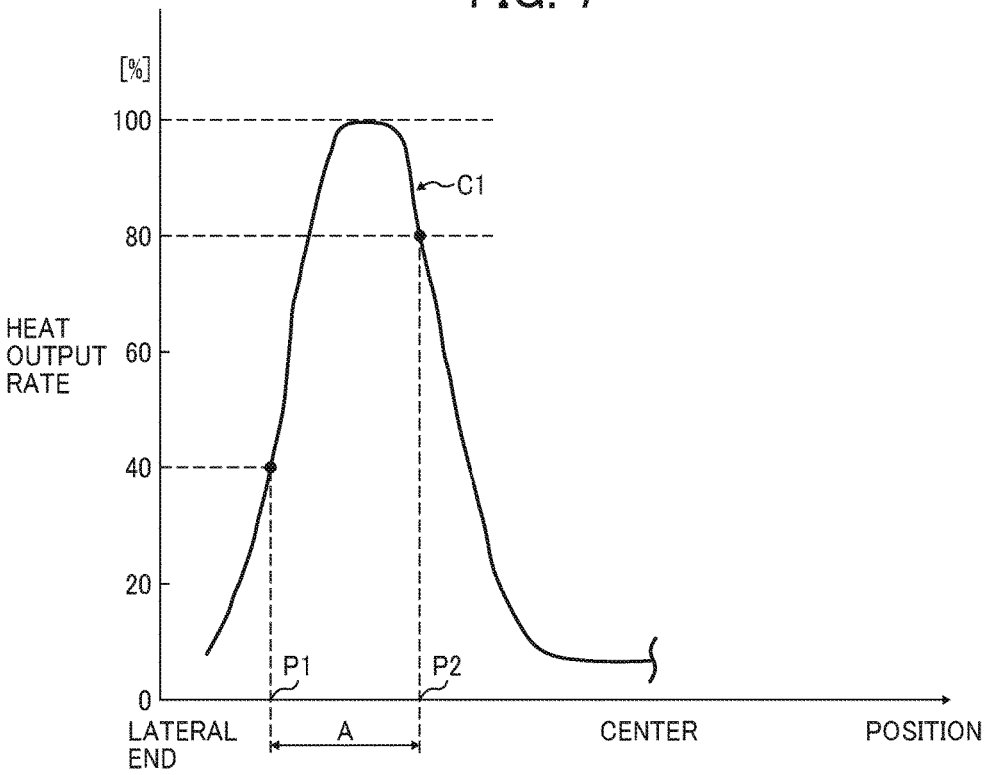
FIG. 7 is a graph illustrating a curve that represents a heat output rate of heat output from the halogen heater depicted in FIG. 6 under a first pattern.

FIG. 7 is a graph illustrating a curve C1 that represents a heat output rate of heat output from the halogen heater 23B serving as a second radiant heater under the first pattern. FIG. 7 illustrates heat output from one lateral end of the halogen heater 23B in the longitudinal direction thereof. In the graph depicted in FIG. 7, a vertical axis represents a heat output rate in percentage of the halogen heater 23B relative to a predetermined heat output rate. A horizontal axis represents the position of the halogen heater 23B in the longitudinal direction thereof. The graph depicted in FIG. 7 illustrates the curve C1 with a vertex like a parabola.

As illustrated in FIG. 7, the border Bc, that is, the inboard lateral edge of the heat generator 42*b* in the longitudinal direction of the lateral end heater 26*b*, at which heat output from the heat generator 42*b* of the lateral end heater 26*b* starts decreasing, is situated in a border span A. The border span A is defined from an outboard position P1 to an inboard position P2 in the longitudinal direction of the halogen heater 23B. At the outboard position P1, heat output from the heat generator 40B of the halogen heater 23B attains a heat output rate of 40 percent relative to a peak heat output rate. At the inboard position P2, heat output from the heat generator 40B of the halogen heater 23B attains a heat output rate of 80 percent relative to the peak heat output rate. The border Bc situated in the border span A renders the heat output rate of heat output from an inboard lateral end of the lateral end heater 26*b* and an outboard lateral end of the halogen heater 23B in the longitudinal direction thereof to be within the predetermined allowable range.

A description is provided of a second pattern of positioning of the border Bc.

Figure 8:
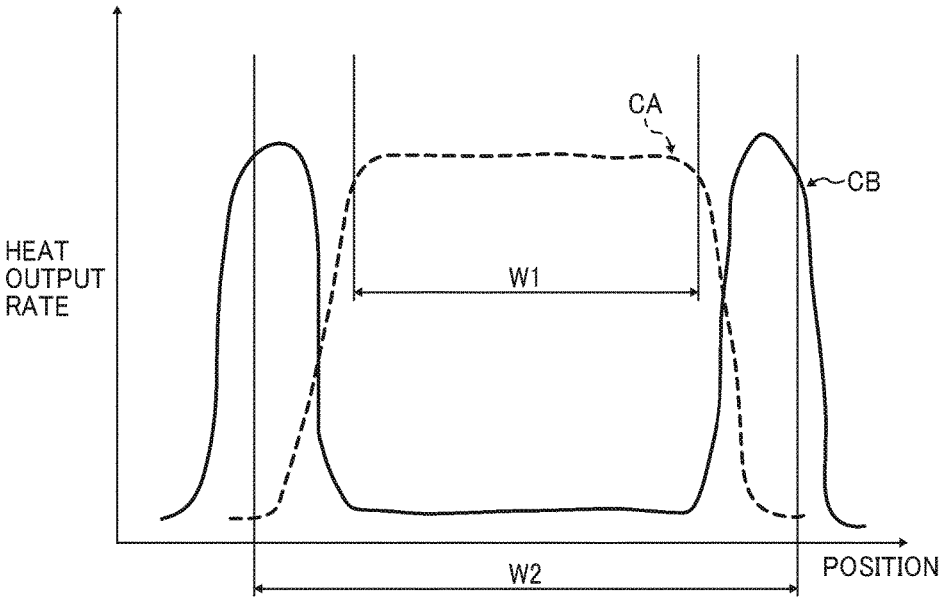
FIG. 8 is a graph illustrating a heat output rate of heat output from the halogen heaters depicted in FIG. 5 under a second pattern.

FIG. 8 is a graph illustrating a heat output rate of heat output from the halogen heater 23A having the heat generator 40A situated in the center span of the halogen heater 23A and the halogen heater 23B having the heat generators 40B situated in each lateral end span of the halogen heater 23B under the second pattern. In the graph depicted in FIG. 8, a curve CA in a dotted line represents heat output from the halogen heater 23A. A curve CB in a solid line represents heat output from the halogen heater 23B. A width W1 represents a width of an A4 size sheet in portrait orientation in the axial direction of the fixing belt 21. A width W2 represents a width of an A4 size sheet in landscape orientation in the axial direction of the fixing belt 21 as a width of the maximum standard size sheet. The halogen heaters 23A and 23B that have different light distributions in the longitudinal direction thereof and therefore have different heat output patterns provide different total heat output patterns, respectively.

Figure 9:
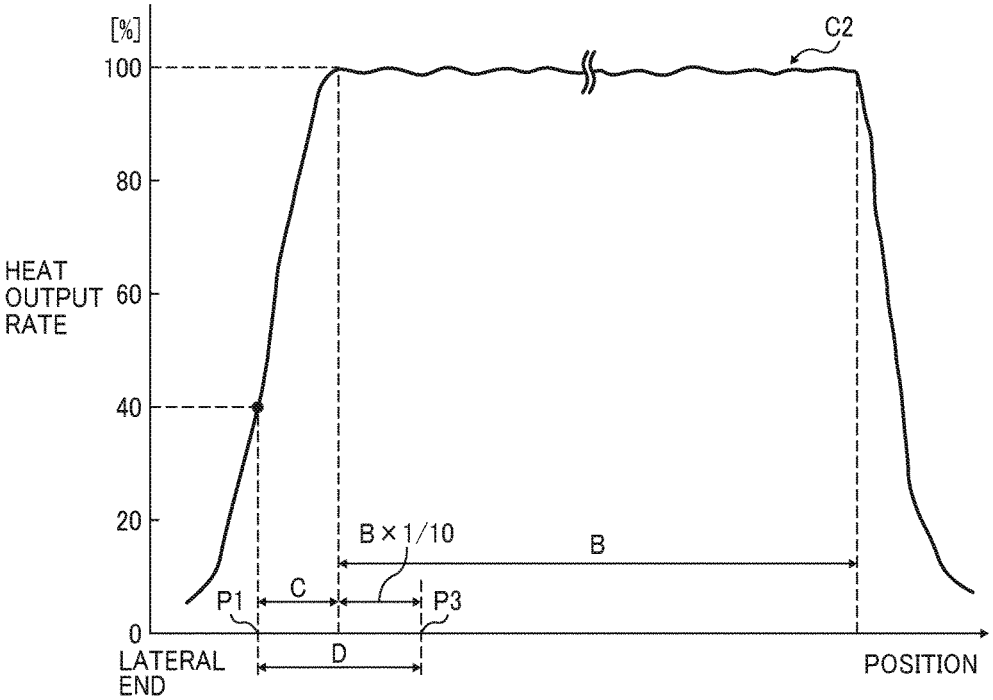
FIG. 9 is a graph illustrating a curve that represents a combined heat output rate of heat output from the halogen heaters depicted in FIG. 5 under the second pattern.

FIG. 9 is a graph illustrating a curve C2 that represents a combined heat output rate of heat output from the halogen heaters 23A and 23B under the second pattern. As illustrated in FIG. 9, the combined heat output rate of the halogen heaters 23A and 23B attains the predetermined heat output rate of 100 percent at a position in proximity to each lateral end span of the halogen heater 23B in the longitudinal direction thereof and a heat output rate of almost 100 percent in the center span of the halogen heater 23A in the longitudinal direction thereof, rendering the curve C2 to be gentle.

In FIG. 9, a span B represents a first combined heat output span where the combined heat output rate of the halogen heaters 23A and 23B attains the heat output rate of almost 100 percent constantly. A span C represents the span where the combined heat output rate of the halogen heaters 23A and 23B attains the heat output rate in the range of from 40 percent to almost 100 percent. The border Bc is disposed in a border span D defined from the outboard position P1 where the halogen heater 23B attains the heat output rate of 40 percent to an inboard position P3 being inboard from the outboard position P1 in the longitudinal direction of the halogen heater 23B by the span C and one tenth of the span B. The border Bc situated in the border span D renders the heat output rate of the inboard lateral end of the lateral end heater 26*b* and the outboard lateral end of the halogen heater 23B in the longitudinal direction thereof to be within the allowable range.

A description is provided of a third pattern of positioning of the border Bc.

Figure 10:
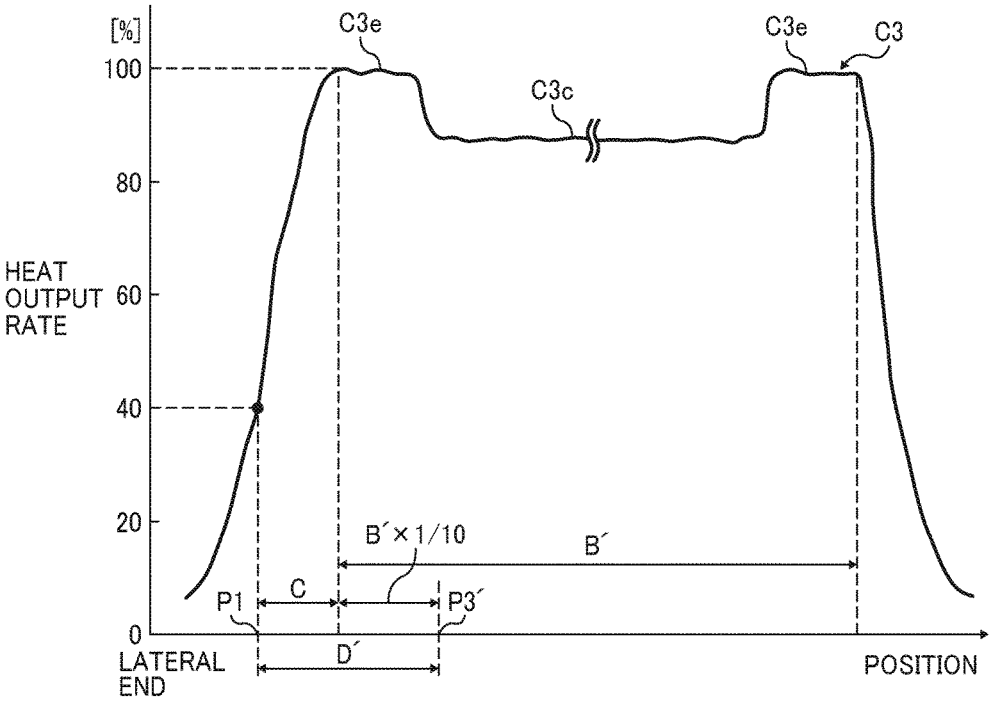
FIG. 10 is a graph illustrating a curve that represents a combined heat output rate of heat output from the halogen heaters depicted in FIG. 5 under a third pattern.

FIG. 10 is a graph illustrating a curve C3 that represents a combined heat output rate of heat output from the halogen heaters 23A and 23B under the third pattern as a variation. As illustrated in FIG. 10, a center part C3*c* of the curve C3 is gentle. Both lateral end parts C3*e* of the curve C3 indicate a heat output rate greater than a heat output rate indicated by the center part C3*c*. The curve C3 is obtained with the filament of each of the heat generators 40B of the halogen heater 23B, which is coiled more densely than the filament of the heat generator 40A of the halogen heater 23A.

In FIG. 10, a span B' represents a span where the combined heat output rate of the halogen heaters 23A and 23B attains the heat output rate of almost 100 percent. The span B' bridges the lateral end parts C3*e*. The span C represents the span where the combined heat output rate of the halogen heaters 23A and 23B attains the heat output rate in the range of from 40 percent to almost 100 percent. The border Bc is disposed in a border span D' defined from the outboard position P1 where the halogen heater 23B attains the heat output rate of 40 percent to an inboard position P3' being inboard from the outboard position P1 in the longitudinal direction of the halogen heater 23B by the span C and one tenth of the span B'. The border Bc situated in the border span D' renders the heat output rate of the inboard lateral end of the lateral end heater 26*b* and the outboard lateral end of the halogen heater 23B in the longitudinal direction thereof to be within the allowable range.

A description is provided of an advantageous configuration of the fixing device 20.

Since the inner circumferential surface of the fixing belt 21 slides over the thermal conduction aid 27, if the thermal conduction aid 27 is made of metal such as copper and aluminum, the thermal conduction aid 27 may increase a coefficient of friction between the fixing belt 21 and the thermal conduction aid 27. As the coefficient of friction increases, a unit torque of the fixing device 20 may increase, shortening a life of the fixing device 20.

To address this circumstance, as illustrated in FIG. 3, the thermal conduction aid 27 incorporates the belt-side face 27*a* being disposed opposite and in contact with the fixing belt 21 such that the fixing belt 21 slides over the belt-side face 27*a*. The belt-side face 27*a* is smooth and treated with processing to reduce friction. For example, the belt-side face 27*a* is coated with a fluorine material such as PFA and PTFE or treated with other coating to reduce friction between the thermal conduction aid 27 and the inner circumferential surface of the fixing belt 21. Alternatively, a lubricant such as fluorine grease and silicone oil may be applied between the thermal conduction aid 27 and the inner circumferential surface of the fixing belt 21 to reduce friction further.

A description is provided of a configuration of another temperature detector, separately provided from the temperature sensor 29 depicted in FIG. 2, which detects a temperature of a part of the fixing belt 21, which is heated by the lateral end heater 26 (e.g., the lateral end heaters 26*a* and 26*b*).

A contact sensor (e.g., a thermistor) is employed to detect the temperature of the fixing belt 21 precisely at reduced costs. However, the contact sensor may produce slight scratches at a contact position on the fixing belt 21 where the contact sensor contacts the fixing belt 21. The slight scratches may damage a toner image formed on a sheet P while the sheet P is conveyed over the fixing belt 21, generating slight variation in gloss of the toner image on the sheet P or the like. To address this circumstance, in the image forming apparatus 1 that forms a color toner image on a sheet P, the contact sensor is not situated within a conveyance span in the axial direction of the fixing belt 21 where the maximum standard size sheet is conveyed over the fixing belt 21.

The extra-large sheet P, that is, an extension size sheet, includes an extension portion used as an edge or a margin abutting on a toner image formed in proximity to a lateral edge of the maximum standard size sheet, a portion where a linear image called a trim mark used for alignment in printing positions is formed, or a portion where a solid patch having a small area for color adjustment is formed. Finally, the extension portion is often trimmed. Hence, even if the contact sensor produces scratches on the fixing belt 21 and the scratches damage a toner image formed on the extension portion of the extra-large sheet P with slight variation in gloss of the toner image or the like, the damaged toner image does not appear on the extra-large sheet P as a faulty toner image after the extension portion is trimmed.

Figure 11:
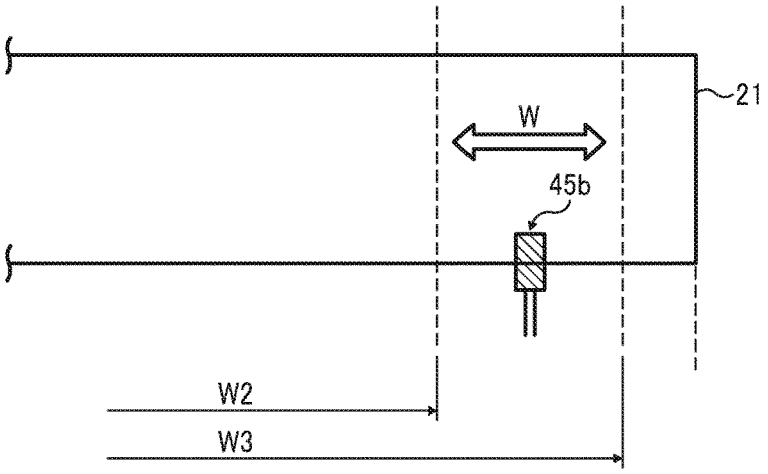
FIG. 11 is a plan view of a temperature detector and a fixing belt incorporated in the fixing device depicted in FIG. 2.

Accordingly, as illustrated in FIG. 11, the fixing device 20 according to this exemplary embodiment includes a plurality of temperature detectors 45*a* and 45*b*, disposed opposite both lateral ends of the fixing belt 21 in the axial direction thereof, to detect a temperature of both lateral ends of the fixing belt 21 that are heated by the lateral end heaters 26*a* and 26*b*, respectively. FIG. 11 is a plan view of the temperature detector 45*b* and the fixing belt 21. FIG. 11 omits illustration of the temperature detector 45*a* disposed symmetrical with the temperature detector 45*b*.

Each of the temperature detectors 45*a* and 45*b* is disposed opposite the outer circumferential surface of the fixing belt 21 and disposed outboard from the conveyance span of the maximum standard size sheet in the axial direction of the fixing belt 21. Each of the temperature detectors 45*a* and 45*b* is disposed within a span W being outboard from a lateral edge of the maximum standard size sheet and inboard from a lateral edge of the extra-large sheet P greater than the maximum standard size sheet in the axial direction of the fixing belt 21. In other words, each of the temperature detectors 45*a* and 45*b* is disposed outboard from the heat generator 40 depicted in FIG. 5 and inboard from a lateral edge of the heat generator 42 in the axial direction of the fixing belt 21. Accordingly, the temperature detectors 45*a* and 45*b* precisely detect the temperature of both lateral ends of the fixing belt 21 that are heated by the lateral end heaters 26*a* and 26*b*, respectively, at reduced costs while preventing a faulty toner image that suffers from slight variation in gloss or the like from appearing on the extra-large sheet P.

FIG. 11 illustrates the width W2 of the A4 size sheet in landscape orientation in the axial direction of the fixing belt 21 as the width of the maximum standard size sheet and a width W3 of the extra-large sheet P in the axial direction of the fixing belt 21 as a width of a maximum extension size sheet.

A description is provided of a construction of a comparative fixing device.

The comparative fixing device includes a thin, flexible endless belt to be heated quickly to a fixing temperature at which a toner image is fixed on a sheet and a nip formation unit located inside a loop formed by the endless belt. The nip formation unit presses against a pressure roller via the endless belt to form a fixing nip between the endless belt and the pressure roller. A plurality of halogen heaters is situated inside the loop formed by the endless belt. The halogen heaters include heat generators that have different light distributions in an axial direction of the endless belt parallel to a width direction of the sheet, respectively.

A plurality of lateral end heaters is disposed opposite both lateral ends of the endless belt in the axial direction thereof, respectively, and upstream from the fixing nip in a rotation direction of the endless belt so as to heat an increased heating span of the endless belt corresponding to a width of a large sheet in the axial direction of the endless belt. The lateral end heaters locally contact an inner circumferential surface or an outer circumferential surface of the endless belt. The local lateral end heaters heat the increased heating span of the endless belt corresponding to the width of the large sheet with a simple construction not incorporating an extra halogen heater directed to the large sheet.

However, if the endless belt does not contact the lateral end heaters precisely, the lateral end heaters may conduct heat to the endless belt unevenly. Thus, the lateral end heaters may suffer from degradation in heating efficiency. To address this circumstance, like in this exemplary embodiment, a thermal conduction aid may cover heat generators of the lateral end heaters. The thermal conduction aid having an enhanced thermal conductivity conducts heat in the axial direction of the endless belt. The thermal conduction aid covering the lateral end heaters facilitates conduction of heat generated by the heat generators of the lateral end heaters to the thermal conduction aid, thus improving heating efficiency of the lateral end heaters. The thermal conduction aid may also serve as a thermal equalizer.

If the thermal conduction aid is longer than a conveyance span of the endless belt where a sheet is conveyed, the thermal conduction aid may conduct heat to an outboard span of the endless belt, which is outboard from the conveyance span of the endless belt in the axial direction thereof, thus increasing power consumption and degrading heating efficiency. To address this circumstance, as a first configuration, the length the thermal conduction aid in the axial direction of the endless belt is minimized relative to a maximum conveyance span of the endless belt where a maximum size sheet is conveyed by considering dimensional tolerance of parts, mounting backlash, variation in size of the sheet, variation in position at which the sheet is conveyed, variation in heating span to heat the endless belt, and the like.

On the other hand, each of the lateral end heaters of the comparative fixing device is a contact heater including a resistive heat generator that generates heat as the resistive heat generator is supplied with power. The resistive heat generator is coupled with an electrode that supplies power to the resistive heat generator. The electrode is attached to the resistive heat generator by brazing or soldering. However, since brazing and soldering do not achieve a sufficient heat resistance, the electrode may suffer from degradation in heat resistance. In order to prevent breakage of the electrode due to temperature increase, as a second configuration, the electrode of the contact heater is disposed outboard from the thermal conduction aid in the axial direction of the endless belt.

However, a length of the endless belt in the axial direction thereof is greater than a length of the thermal conduction aid in view of a position of the nip formation unit that supports the endless belt and a length of the pressure roller in an axial direction thereof. Accordingly, with the first configuration and the second configuration described above, the contact heater disposed opposite each lateral end of the thermal conduction aid may be disposed in proximity to or in contact with an inner circumferential surface of the endless belt.

To address this circumstance, the fixing device 20 according to this exemplary embodiment has a configuration described below that prevents the electrode of the contact heater that heats each lateral end of the endless belt (e.g., the fixing belt 21) in the axial direction thereof from being overheated and broken and prevents the electrode from coming into contact with the endless belt.

A description is provided of three exemplary embodiments of a construction of the lateral end heaters 26*a* and 26*b* and arrangement of the lateral end heaters 26*a* and 26*b* and the thermal conduction aid 27.

A description is provided of a construction of the lateral end heater 26*b* and arrangement of the lateral end heater 26*b* and the thermal conduction aid 27 according to a first exemplary embodiment.

Figure 12A:
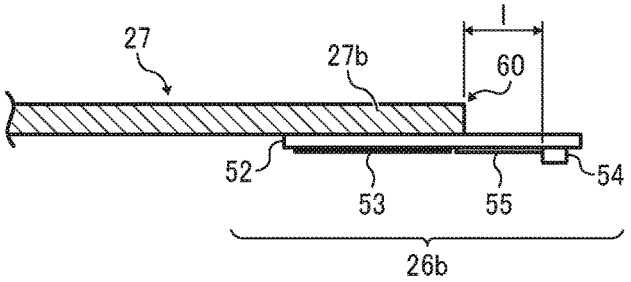
FIG. 12A is a cross-sectional view of the lateral end heater and a thermal conduction aid incorporated in the fixing device depicted in FIG. 2 according to a first exemplary embodiment.
Figure 12B:
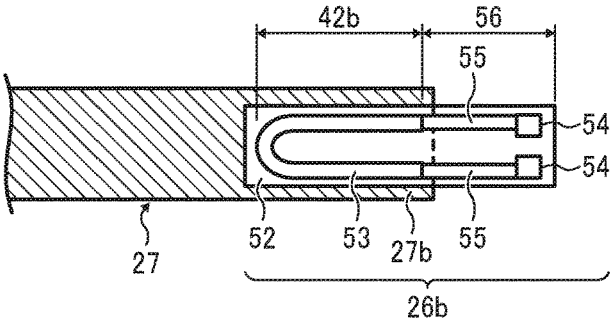
FIG. 12B is a front view of the lateral end heater and the thermal conduction aid depicted in FIG. 12A.

FIG. 12A is a cross-sectional view of the lateral end heater 26*b* and the thermal conduction aid 27. FIG. 12B is a front view of the lateral end heater 26*b* and the thermal conduction aid 27. Although FIGS. 12A and 12B illustrate the lateral end heater 26*b*, the lateral end heater 26*a* is symmetrical with the lateral end heater 26*b* and has a construction similar to a construction of the lateral end heater 26*b* described below.

As illustrated in FIGS. 12A and 12B, the lateral end heater 26*b* includes a base 52, a resistor 53, a plurality of electrodes 54, and a plurality of conductors 55. The resistor 53 is mounted on the base 52. The plurality of electrodes 54 is mounted on the base 52 and coupled to an external power supply. The electrodes 54 supply power to the resistor 53. The conductors 55 are mounted on the base 52. Each of the conductors 55 is a joint that couples the resistor 53 with the electrode 54.

The base 52 contacts a lateral end 27*b* of the thermal conduction aid 27 and extends beyond the lateral end 27*b* of the thermal conduction aid 27 in the longitudinal direction thereof. The base 52 is made of ceramics, for example. The resistor 53 is a resistive heat generator that generates heat as the resistive heat generator is supplied with power. The resistor 53 is substantially U-shaped, for example, as illustrated in FIG. 12B.

Each of the electrodes 54 is spaced apart from the resistor 53 via the conductor 55 so that a joint portion of the electrode 54, that is treated with brazing or soldering, is not broken by heat generated by the resistor 53. The resistor 53 is disposed opposite the lateral end 27*b* of the thermal conduction aid 27 in the longitudinal direction thereof. Conversely, the electrodes 54 are disposed outboard from the lateral end 27*b* of the thermal conduction aid 27 in the longitudinal direction thereof. A distance I defined from an outboard edge of the heat generator 42*b* to an inboard edge of the electrode 54 in the longitudinal direction of the thermal conduction aid 27 is not smaller than 10 mm when the resistor 53 is supplied with power of 55 W. For example according to this exemplary embodiment, the distance I is 12 mm. In order to increase heat resistance of the electrodes 54, the electrodes 54 may be attached to the conductors 55 with high melting point solder or silver.

As illustrated in FIG. 12B, the thermal conduction aid 27 is disposed opposite the base 52 of the lateral end heater 26*b* and covers the heat generator 42*b* of the lateral end heater 26*b*.

Accordingly, as the electrodes 54 are supplied with power, the resistor 53 generates heat. A temperature of the heat generator 42*b* defined by the resistor 53 increases to a high temperature. Heat generated by the heat generator 42*b* is conducted to the thermal conduction aid 27. Conversely, heat generated by the heat generator 42*b* is barely conducted to the electrodes 54 spaced apart from the heat generator 42*b*, preventing overheating of the electrodes 54.

A length of the fixing belt 21 in the axial direction thereof is greater than a length of the thermal conduction aid 27 in view of a position of the nip formation pad 24 that supports the fixing belt 21 and a length of the pressure roller 22 in the axial direction thereof. As described above, since the thermal conduction aid 27 is made of copper, aluminum, or the like, a rigidity of the thermal conduction aid 27 is greater than a rigidity of the fixing belt 21. Accordingly, as the fixing belt 21 rotates, a corner 60 disposed at each lateral edge of the thermal conduction aid 27 in the longitudinal direction thereof may damage the inner circumferential surface of the fixing belt 21, shortening a life of the fixing belt 21. Additionally, a power supply portion 56 of the lateral end heater 26*b*, that is disposed outboard from the lateral end 27*b* of the thermal conduction aid 27 in the longitudinal direction thereof, may be disposed in proximity to or in contact with the inner circumferential surface of the fixing belt 21.

A description is provided of a construction of the lateral end heater 26*b* and arrangement of the lateral end heater 26*b* and the thermal conduction aid 27 according to a second exemplary embodiment.

Figure 13A:
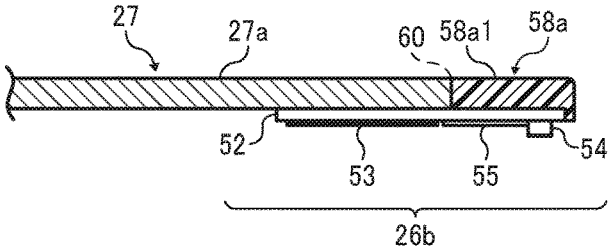
FIG. 13A is a cross-sectional view of the lateral end heater and the thermal conduction aid incorporated in the fixing device depicted in FIG. 2 according to a second exemplary embodiment.
Figure 13B:
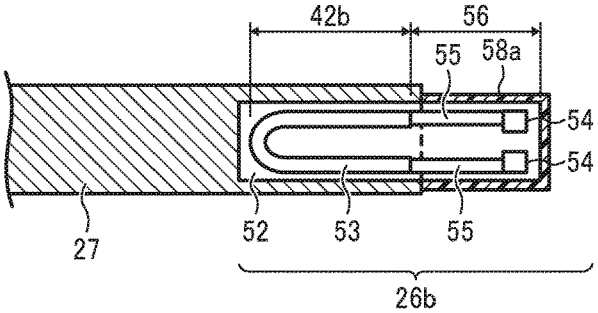
FIG. 13B is a front view of the lateral end heater and the thermal conduction aid depicted in FIG. 13A.

FIG. 13A is a cross-sectional view of the lateral end heater 26*b* and the thermal conduction aid 27. FIG. 13B is a front view of the lateral end heater 26*b* and the thermal conduction aid 27. Identical reference numerals are assigned to components illustrated in FIGS. 13A and 13B that are identical to the components illustrated in FIGS. 12A and 12B and description of the identical components is omitted.

According to the second exemplary embodiment, in order to prevent the power supply portion 56 from being disposed in proximity to or in contact with the inner circumferential surface of the fixing belt 21, a cover 58*a* covers the power supply portion 56. The cover 58*a* is made of heat resistant resin, such as liquid crystal polymer (LCP), polyphenylenesulfide (PPS), and PFA, which is softer than the material of the thermal conduction aid 27. As illustrated in FIG. 13A, the cover 58*a* includes a belt-side face 58*a*1 disposed opposite the inner circumferential surface of the fixing belt 21. The belt-side face 58*a*1 of the cover 58*a* and the belt-side face 27*a* of the thermal conduction aid 27, which are disposed opposite the fixing belt 21, define an identical plane. Accordingly, the cover 58*a* covers the corner 60 disposed at the lateral edge of the thermal conduction aid 27, preventing the corner 60 from coming into contact with the inner circumferential surface of the fixing belt 21 and damaging the fixing belt 21.

A description is provided of a construction of the lateral end heater 26*b* and arrangement of the lateral end heater 26*b* and the thermal conduction aid 27 according to a third exemplary embodiment.

Figure 14A:
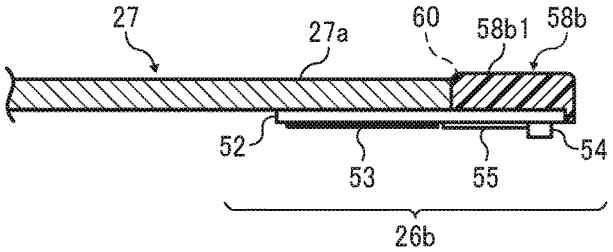
FIG. 14A is a cross-sectional view of the lateral end heater and the thermal conduction aid incorporated in the fixing device depicted in FIG. 2 according to a third exemplary embodiment.
Figure 14B:
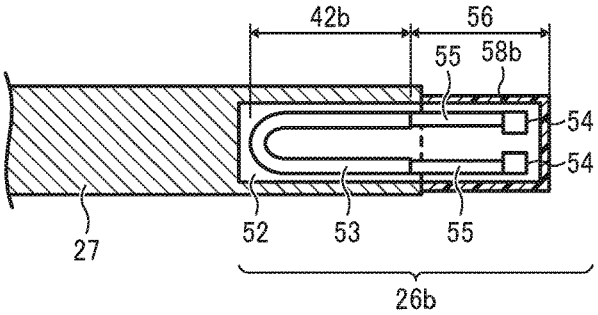
FIG. 14B is a front view of the lateral end heater and the thermal conduction aid depicted in FIG. 14A.

FIG. 14A is a cross-sectional view of the lateral end heater 26*b* and the thermal conduction aid 27. FIG. 14B is a front view of the lateral end heater 26*b* and the thermal conduction aid 27. Identical reference numerals are assigned to components illustrated in FIGS. 14A and 14B that are identical to the components illustrated in FIGS. 12A, 12B, 13A, and 13B and description of the identical components is omitted.

As illustrated in FIG. 14A, a cover 58*b* includes a belt-side face 58*b*1 disposed opposite the inner circumferential surface of the fixing belt 21. The belt-side face 58*b*1 of the cover 58*b* projects toward the fixing belt 21 beyond the belt-side face 27*a* of the thermal conduction aid 27. Like the cover 58*a* according to the second exemplary embodiment depicted in FIGS. 13A and 13B, the cover 58*b* covers the corner 60 disposed at the lateral edge of the thermal conduction aid 27, preventing the corner 60 from coming into contact with the inner circumferential surface of the fixing belt 21 and damaging the fixing belt 21. The cover 58*b* prevents the power supply portion 56 of the lateral end heater 26*b* from coming into contact with the inner circumferential surface of the fixing belt 21.

The belt-side face 58*b*1 of the cover 58*b* is smooth and treated with processing to reduce friction. Accordingly, even if the cover 58*b* comes into contact with the fixing belt 21, the cover 58*b* does not degrade rotation of the fixing belt 21.

A description is provided of advantages of the fixing device 20.

As illustrated in FIG. 2, the fixing device 20 includes an endless belt (e.g., the fixing belt 21) that is flexible, formed into a loop, and rotatable in a rotation direction (e.g., the rotation direction D21). A pressure rotator (e.g., the pressure roller 22) is disposed outside the loop formed by the endless belt and disposed opposite an outer circumferential surface of the endless belt. A plurality of radiant heaters (e.g., the halogen heaters 23A and 23B) having different light distributions in an axial direction of the endless belt, respectively, is disposed inside the loop formed by the endless belt. A nip formation pad (e.g., the nip formation pad 24) is disposed opposite the inner circumferential surface of the endless belt. The nip formation pad forms a fixing nip (e.g., the fixing nip N) between the endless belt and the pressure rotator.

As illustrated in FIG. 3, a contact heater (e.g., the lateral end heaters 26*a* and 26*b*) is disposed at least at one lateral end of the nip formation pad in a longitudinal direction thereof. The contact heater heats at least one lateral end of the endless belt in the axial direction thereof. The nip formation pad includes a belt-side face (e.g., the belt-side face 24*c*) disposed opposite the endless belt. The contact heater includes a belt-side face (e.g., the belt-side face 26*c*) disposed opposite the endless belt. A thermal conduction aid (e.g., the thermal conduction aid 27) covers the belt-side face of the nip formation pad and the belt-side face of the contact heater. The thermal conduction aid conducts heat in the axial direction of the endless belt.

As illustrated in FIGS. 12A and 12B, the contact heater includes a base (e.g., the base 52), a resistor (e.g., the resistor 53), an electrode (e.g., the electrode 54), and a conductor (e.g., the conductor 55). The resistor is mounted on the base. The resistor generates heat as the resistor is supplied with power. The electrode is mounted on the base and disposed outboard from the thermal conduction aid in a longitudinal direction of the thermal conduction aid. The electrode supplies power to the resistor. The conductor is mounted on the base. The conductor couples the resistor to the electrode.

The contact heater further includes a power supply portion (e.g., the power supply portion 56) provided with the electrode. At least the power supply portion of the contact heater is disposed outboard from a lateral end (e.g., the lateral end 27*b*) of the thermal conduction aid in the longitudinal direction thereof.

As illustrated in FIGS. 13A and 14A, a cover (e.g., the covers 58*a* and 58*b*) is disposed outboard from the thermal conduction aid in the longitudinal direction thereof. The cover covers the belt-side face of the contact heater.

The power supply portion of the contact heater, which is provided with the electrode, is disposed outboard from the lateral end of the thermal conduction aid in the longitudinal direction thereof. Accordingly, heat is not conducted from the resistor to the electrode easily, preventing overheating of the electrode. Additionally, the cover covers the belt-side face of the contact heater, which is disposed opposite the endless belt, preventing the power supply portion of the contact heater from coming into contact with an inner circumferential surface of the endless belt.

The electrode of the contact heater that heats each lateral end of the endless belt in the axial direction thereof is immune from overheating, breakage, and contact with the endless belt.

According to the exemplary embodiments described above, as illustrated in FIG. 5, the fixing device 20 employs a center conveyance system in which the sheet P is centered on the fixing belt 21 in the axial direction thereof. Alternatively, the fixing device 20 may employ a lateral end conveyance system in which the sheet P is conveyed in the sheet conveyance direction DP along one lateral end of the fixing belt 21 in the axial direction thereof. In this case, one of the heat generators 40B of the halogen heater 23B and one of the lateral end heaters 26*a* and 26*b* are eliminated. Another one of the heat generators 40B of the halogen heater 23B and another one of the lateral end heaters 26*a* and 26*b* are distal from the one lateral end of the fixing belt 21 in the axial direction thereof.

According to the exemplary embodiments described above, the fixing belt 21 serves as an endless belt. Alternatively, a fixing film, a fixing sleeve, or the like may be used as an endless belt. Further, the pressure roller 22 serves as a pressure rotator. Alternatively, a pressure belt or the like may be used as a pressure rotator.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. A fixing device comprising:

an endless belt that is flexible;

a pressure rotator disposed opposite an outer circumferential surface of the endless belt;

a nip formation pad disposed opposite an inner circumferential surface of the endless belt, to form a fixing nip between the endless belt and the pressure rotator, the nip formation pad including a belt-side face disposed opposite the endless belt;

at least one radiant heater disposed opposite the inner circumferential surface of the endless belt, to heat the endless belt;

a pair of contact heaters mounted at lateral ends of the nip formation pad in a longitudinal direction of the nip formation pad, the contact heaters to heat lateral ends of the endless belt, the longitudinal direction being parallel with a direction of sheet width and perpendicular to a direction of sheet conveyance through the fixing nip;

a thermal conduction aid disposed over a belt-side face of the nip formation pad in the longitudinal direction and contacting an inner portion of the contact heaters to conduct heat in the longitudinal direction; and a pair of covers extending from lateral ends of the thermal conduction aid in the longitudinal direction to cover an outer portion of the contact heaters, wherein the outer portion of each of the contact heaters includes a power supply disposed outboard from the thermal conduction aid in the longitudinal direction of the thermal conduction aid that is covered by the covers.

2. The fixing device according to claim 1,
wherein each of the contact heaters further includes:
a base;
a resistor mounted on the base to generate heat as the resistor is supplied with power;
an electrode mounted on the base to supply power to the resistor; and
a conductor mounted on the base to couple the resistor to the electrode.

3. The fixing device according to claim 2,
wherein the power supply of each of the contact heaters include the electrode.

4. The fixing device according to claim 2,
wherein the at least one radiant heater includes:
a first radiant heater disposed opposite the inner circumferential surface of the endless belt, the first radiant heater including a first heat generator to heat the endless belt; and
a second radiant heater disposed opposite the inner circumferential surface of the endless belt, the second radiant heater including a second heat generator, disposed outboard from the first heat generator in the longitudinal direction to heat the endless belt.

5. The fixing device according to claim 4,
wherein each of the contact heaters include a third heat generator that includes the resistor to generate heat, and
wherein a distance defined from an outboard edge of the third heat generator to an inboard edge of the electrode in the longitudinal direction exceeds 10 mm.

6. The fixing device according to claim 1,
wherein the thermal conduction aid includes a belt-side face disposed opposite the endless belt and each of the covers include a belt-side face disposed opposite the endless belt.

7. The fixing device according to claim 6,
wherein the belt-side face of the thermal conduction aid and the belt-side face of each of the covers define an identical plane.

8. The fixing device according to claim 6,
wherein the belt-side face of each of the covers projects toward the endless belt beyond the belt-side face of the thermal conduction aid.

9. The fixing device according to claim 1,
wherein the covers are made of a heat resistant resin.

10. The fixing device according to claim 9,
wherein the covers are softer than the thermal conduction aid.

11. The fixing device according to claim 1,
wherein the thermal conduction aid includes corners disposed at lateral edges that are covered by the covers.

12. An image forming apparatus comprising:
an image forming device to form a toner image; and
a fixing device disposed downstream from the image forming device in a recording medium conveyance direction to fix the toner image on a recording medium,
the fixing device including:
an endless belt that is flexible;
a pressure rotator disposed opposite an outer circumferential surface of the endless belt;
a nip formation pad disposed opposite an inner circumferential surface of the endless belt to form a fixing nip between the endless belt and the pressure rotator, the nip formation pad including a belt-side face disposed opposite the endless belt;
at least one radiant heater disposed opposite the inner circumferential surface of the endless belt to heat the endless belt;
a pair of contact heaters mounted at lateral ends of the nip formation pad in a longitudinal direction of the nip formation pad, the contact heaters to heat lateral ends of the endless belt, the longitudinal direction being parallel with a direction of recording medium width and perpendicular to the recording medium conveyance direction;
a thermal conduction aid disposed over a belt-side face of the nip formation pad in the longitudinal direction and contacting an inner portion of the contact heaters to conduct heat in the longitudinal direction; and
a pair of covers extending from lateral ends of the thermal conduction aid in the longitudinal direction to cover an outer portion face of the contact heaters,
wherein the outer portion of each of the contact heaters includes a power supply disposed outboard from the thermal conduction aid in the longitudinal direction of the thermal conduction aid that is covered by the covers.

* * * * *